United States Patent [19]

Rutter

[11] Patent Number: 5,002,000

[45] Date of Patent: Mar. 26, 1991

[54] AUTOMATIC LEVELER FOR BOAT LIFTS

[76] Inventor: Henry A. Rutter, 2301 W. 21st St. N., Claremore, Okla. 74017

[21] Appl. No.: 462,693

[22] Filed: Jan. 9, 1990

[51] Int. Cl.[5] ..... B63C 1/02

[52] U.S. Cl. ..... 114/45; 114/49; 405/3; 200/61.52

[58] Field of Search ..... 114/44, 45, 46, 48, 114/49, 52, 53, 123; 200/61.52, 61.45; 248/346; 405/3

[56] References Cited

U.S. PATENT DOCUMENTS

| | | | |
|---|---|---|---|
| 999,012 | 7/1911 | Danziger | 431/249 |
| 2,756,298 | 7/1956 | Lewis | 200/61.52 |
| 2,758,195 | 8/1956 | Ludwig | 200/61.52 |
| 3,269,685 | 8/1966 | Wallace | 248/346 |
| 3,270,698 | 9/1966 | Fort | 114/45 |
| 3,315,627 | 4/1967 | Roberts | 114/45 |
| 3,603,276 | 9/1971 | DeLisle | 114/45 |
| 3,736,898 | 6/1973 | Yamura | 114/45 |
| 3,857,248 | 12/1974 | Rutter | 114/45 |
| 3,967,570 | 7/1976 | Bradfield | 114/45 |
| 4,018,179 | 4/1977 | Rutter | 114/45 |
| 4,072,119 | 2/1978 | Williams | 114/45 |
| 4,273,061 | 6/1981 | Lundberg | 114/45 |
| 4,495,880 | 1/1985 | Maniscalco | 114/123 |
| 4,618,746 | 10/1986 | Schwab | 200/61.45 |
| 4,763,592 | 8/1988 | Russ | 405/3 |
| 4,782,778 | 11/1988 | Barbaglia | 114/52 |

*Primary Examiner*—Jes Sotelo
*Attorney, Agent, or Firm*—Head & Johnson

[57] ABSTRACT

A boat lift and leveler are provided in which the boat lift consists of a cradle supported by at least two pontoons laterally disposed beneath and fixed to the cradle. A leveler for the lift includes a pair of pneumatic duct systems. One of the systems connects to air vents on the starboard side pontoons and the other system connects to air vents on the port side pontoons. Each system includes an intake path, an exhaust path and a valve in each path. The intake path is connected to a source of air under pressure and the exhaust path extends to the atmosphere. An enclosure fixed to the lift lists to starboard or port with the lift. A V-shaped track rests in the enclosure. The track has a starboard arm which rotates below horizontal at a predetermined degree of starboard list of the enclosure and a port arm which rotates below horizontal at a predetermined degree of port list of the enclosure. One mechanism automatically closes the intake path valve to the pontoons on the starboard side of the lift when the port arm falls below horizontal during the lifting process. A similar mechanism controls the port side pontoons in response to the starboard arm. Another mechanism automatically closes the exhaust path valve to the pontoons on the starboard side of the lift when the starboard arm falls below horizontal during the lowering process. A similar mechanism controls the port side pontoons in response to the port arm.

18 Claims, 12 Drawing Sheets

AUTOMATIC LEVELER FOR BOAT LIFTS

BACKGROUND OF THE INVENTION

This invention concerns boat lifts and more particularly concerns automatic levellers for pneumatically operated boat lifts.

The use of pneumatically operated boat lifts to dry-dock boats during temporary periods of non-use is a fairly common practice. All such lifts presently known suffer from some basic inadequacies. Most of them require some sort of support structure on both sides of the lift such as a dock or pier or the like. This double-dock structural requirement increases the cost and complexity of the overall boat lift project. Many lifts require the use of dock mounted control boxes which are subject to vandalism and use up valuable dock space. Other lifts incorporate no means whatsoever for levelling the lift during the lifting and lowering processes. No known lift provides a pneumatic system for levelling itself in automatic response to unacceptable degrees of list during the lifting and lowering processes. Consequently, changes in wind and wave conditions, weight distribution imbalances in either the boat or the lift or unequal rates of pneumatic flow in the lift system can result in damage to, or capsizing of, the boat and even the lift during these processes.

It is, therefore, an object of this invention to provide a boat lift and leveller which can be used without the requirement for support on both sides of the lift. Another object of the invention is to provide a boat lift and leveler which employ controls mounted on the lift rather than on the dock. It is further an object of this invention to provide a boat lift which incorporates an automatic self-levelling system to maintain the stability of the lift during the lifting and levelling processes. And it is an object of this invention to provide a boat lift and leveler which incorporates an automatic self-leveling system which maintains the stability of the lift during storage.

SUMMARY OF THE INVENTION

In accordance with the invention a boat lift and leveler are provided in which the boat lift consists of a cradle supported by at least two pontoons laterally disposed beneath and fixed to the cradle. Preferably, each of the pontoons will have a water vent through its rear lower surface and an air vent through its forward upper surface so that the rear portions of the pontoons and the cradle will tend to be more submerged than the forward portions.

The leveler includes a pair of pneumatic duct systems. One of the systems connects to the air vents of the starboard side pontoons and the other system connects to the air vents of the port side pontoons. Each system includes an intake path and an exhaust path and a valve in each path. The intake path is connected to a source of air under pressure and the exhaust path extends to the atmosphere. A switching system enables the user to selectively open the intake path valves or the exhaust path valves to raise or lower the lift.

An enclosure fixed to the lift lists to starboard or port with the lift. A V-shaped track rests in the enclosure. The track has a starboard arm which rotates below horizontal at a predetermined degree of starboard list of the enclosure and a port arm which rotates below horizontal at a predetermined degree of port list of the enclosure. Balls on each arm of the V-shaped track move toward an extremity of the track when their respective arms rotate below horizontal and move toward the center of the V-shaped track when their respective arms are above horizontal. The movement of the balls in response to listing of the lift triggers one or more of several valve control mechanisms, depending on the location of the balls. One mechanism automatically closes the intake path valve to the pontoons on the starboard side of the lift when the port arm is below horizontal during the lifting process. A similar mechanism controls the port side pontoons in response to the starboard arm. Another mechanism automatically closes the exhaust path valve to the pontoons on the starboard side of the lift when the starboard arm is below horizontal during the lowering process. A similar mechanism controls the port side pontoons in response to the port arm. Thus the lagging side of the lift will be allowed to catch up with the other side during the lifting and lowering processes to keep the lift and boat substantially level at all times. Additionally, another mechanism slightly opens the starboard exhaust path valve in response to the port arm falling below horizontal while its counterpart slightly opens the port exhaust path valve in response to the starboard arm falling below horizontal, thus keeping the lift level even if a leak should occur in the pneumatic system while the lift is in the storage position.

In a preferred embodiment, the V-shaped track includes a pair of fulcra, one fixed to the underside of each of the arms. When the ball nears the extremity of one of the arms, the V-shaped track operates as a lever about the fulcrum of that arm. The rotation of the V-shaped track about the fulcrum in turn operates one of the several valve control mechanisms above mentioned. In this embodiment, these mechanisms include at least three starboard lever mechanisms, one linked to the intake valve and the other two linked to the exhaust valve of the starboard pontoons, and at least three port lever mechanisms, one linked to the intake valve and the other two linked to the exhaust valve of the port pontoons. These lever mechanisms operate either to override the activated selective switching system which would otherwise hold the selected valves open regardless of the degree of list of the lift or to override the deactivated switching system which would otherwise hold all valves closed.

Normally, the only part of the levelling system which will be mounted on the dock is the switch of the selective switching system which enables the user to activate the lifting or lowering process. However, this can be accomplished by a remote switch as well. If circumstances warrant, the lift and leveler system requires no dock whatsoever but may be independently floated using only a mooring device to secure its location.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
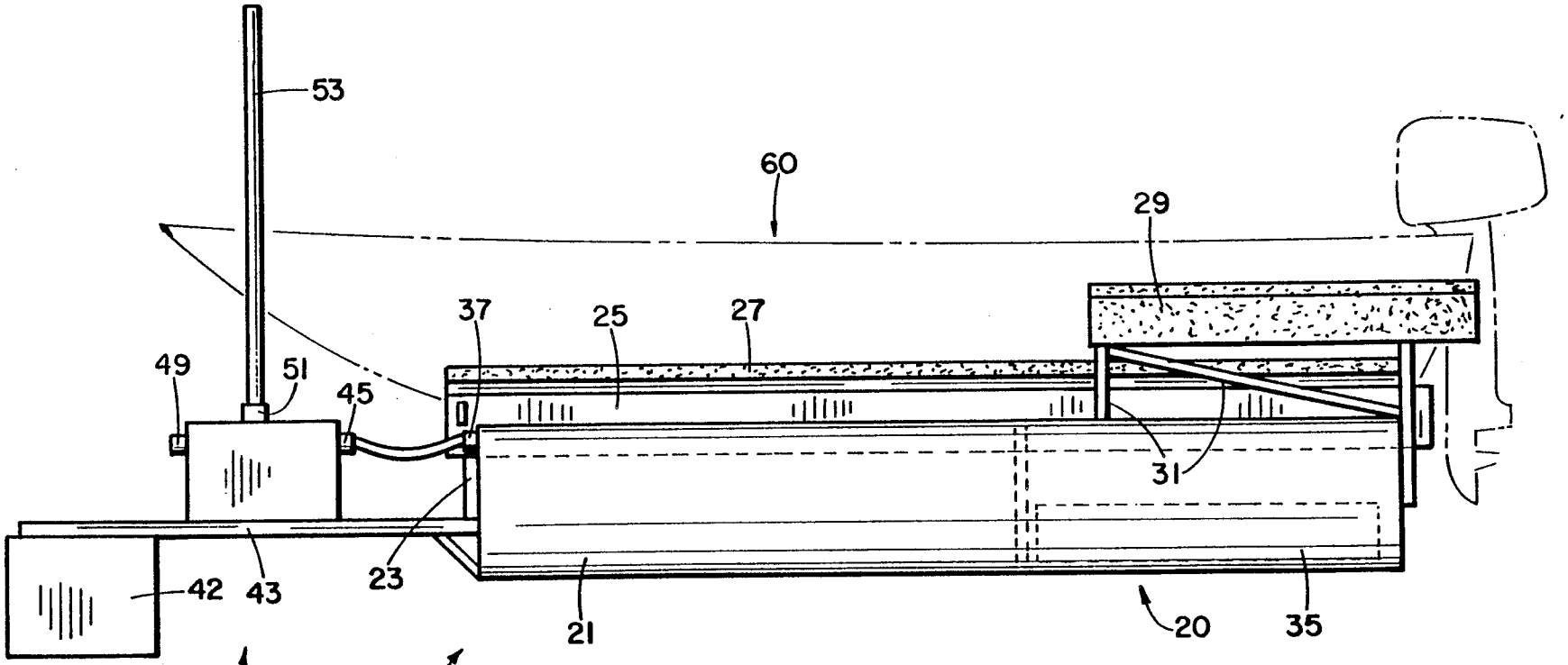
FIG. 1 is an elevational view of the self-leveling boat lift including the boat shown in phantom.
Figure 2:
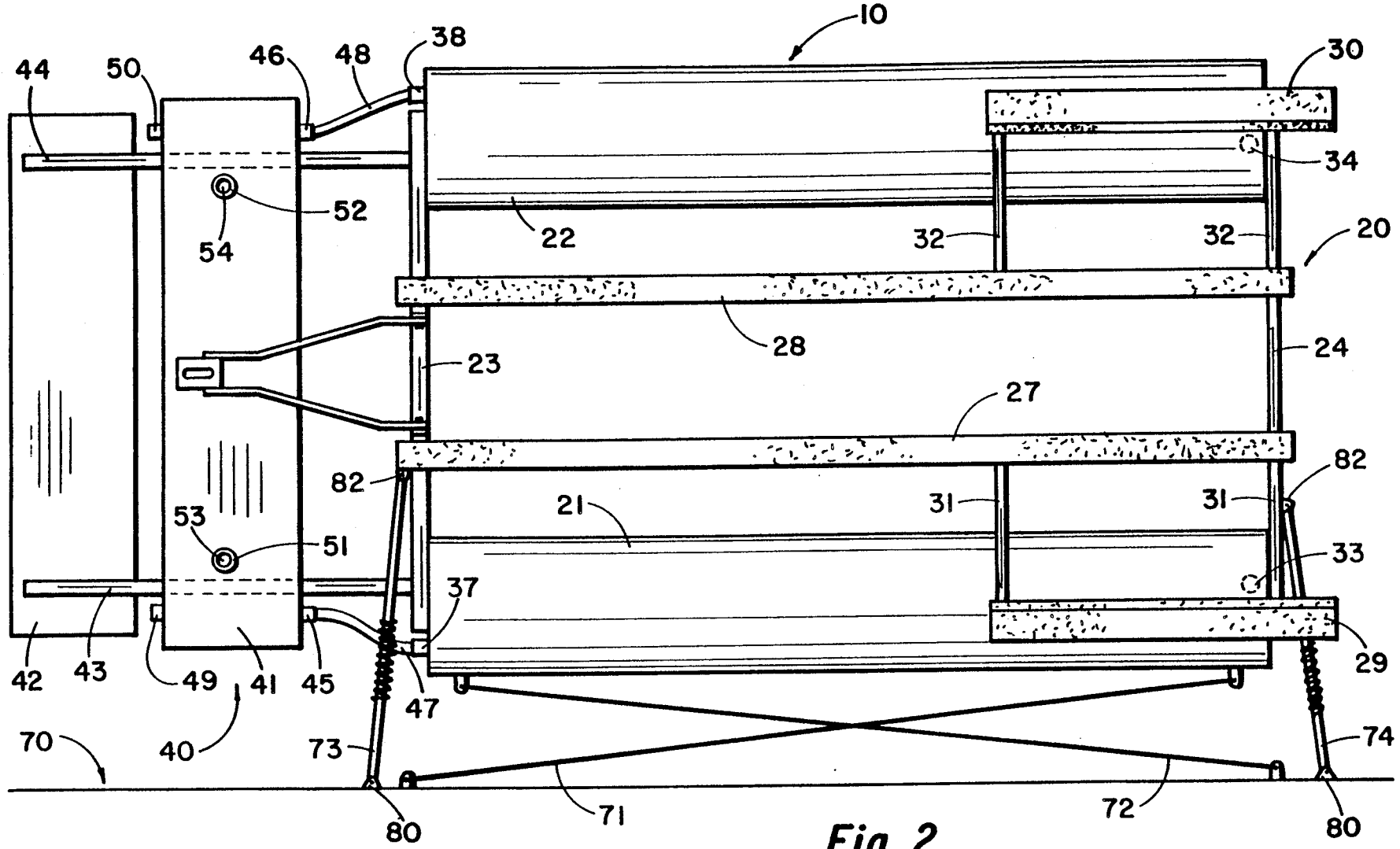
FIG. 2 is a plan view of the self-leveling boat lift of FIG. 1.
Figure 3:
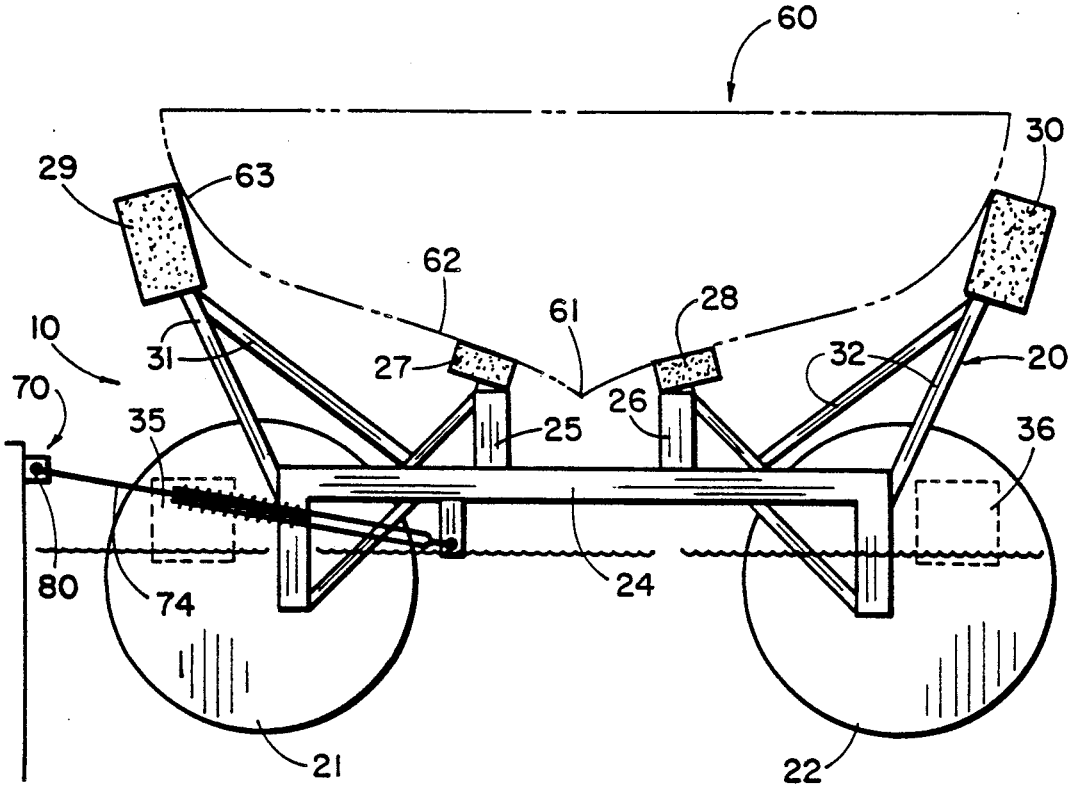
FIG. 3 is a rear elevation of the self-leveling boat lift of FIG. 1.

FIGS. 1, 2 and 3 illustrate the use of a self-leveling lift 10, including a cradle section 20 and a leveling section 40 to support a boat 60 which is shown in phantom. In the embodiment illustrated the cradle section 20 includes a port pontoon 21 and a starboard pontoon 22, each consisting of a single cylindrical tank, spaced apart and connected by cross members 23 and 24 at the front and rear of the pontoons 21 and 22. The starboard and port pontoons 21 and 22 could each consist of more than a single tank. A pair of lengthwise keel supports 25 and 26 are fixed to and spaced apart on top of the cross members 23 and 24 to receive the keel 61 of the boat 60 between them. Keel holders 27 and 28 mounted atop the lengthwise supports 25 and 26 are inwardly downwardly angled to provide maximum support to the hull 62 of the boat. A pair of stern supports 29 and 30 are supported upwardly and outwardly of the cradle frame by strut assemblies 31 and 32 at a height and angle suitable to support the upper stern section 63 of the boat 60 when the boat 60 is fully loaded onto the cradle 20. Each of the pontoons 21 and 22 has an open water vent 33 or 34 through its lower rear surface and may have a segment of styrofoam 35 or 36 within its rear section to increase the buoyancy of the stern of the lift 10. Each of the pontoons 21 and 22 is also provided with an air vent 37 or 38 through its upper forward surface. Thus, when the air vents 37 and 38 are open, the weight of the lift 10 causes water to be vented into the pontoons 21 and 22 through the water vents 33 and 34 as the air is evacuated. Conversely, when air is forced under pressure into the pontoons 21 and 22 through the air vents 37 and 38, water will be evacuated through water vents 33 and 34. If the air vents 37 and 38 are totally blocked, the air to water ratio in the pontoons 21 and 22 will remain stable.

The leveling section 40 of the lift 10 consists of a control enclosure 41 and a ballast enclosure 42 mounted across a pair of support members 43 and 44 which are fixed to and extend forwardly of the cradle section 20. The ballast box 42 is mounted below the support members 43 and 44 so as to be always at least partially submerged. The ballast enclosure 42 is generally filled with water although other forms of ballast could be used. The ballast section 42 minimizes the possibility that the forward portion of the cradle 20 will become excessively higher than the stern portion of the cradle 20. The control enclosure 41 is mounted above the support members 43 and 44 and houses the lift pneumatic components and controls which will be hereinafter explained. This enclosure 41 includes rear air ducts 45 and 46 which are connected to the air vents 37 and 38 in the pontoons 21 and 22 by conduits 47 and 48. Air vents 49 and 50 in the forward portion of the control enclosure 41 vent the enclosure 41 to the atmosphere. Air intake ports 51 and 52 provided through the top of the control enclosure 41 permit the flow of air into the enclosure 41. A pair of air intake pipes 53 and 54 extend upwardly from the ports 51 and 52 to assure that water will not infiltrate the enclosure 41 through the air intake ports 51 and 52.

Figure 5:
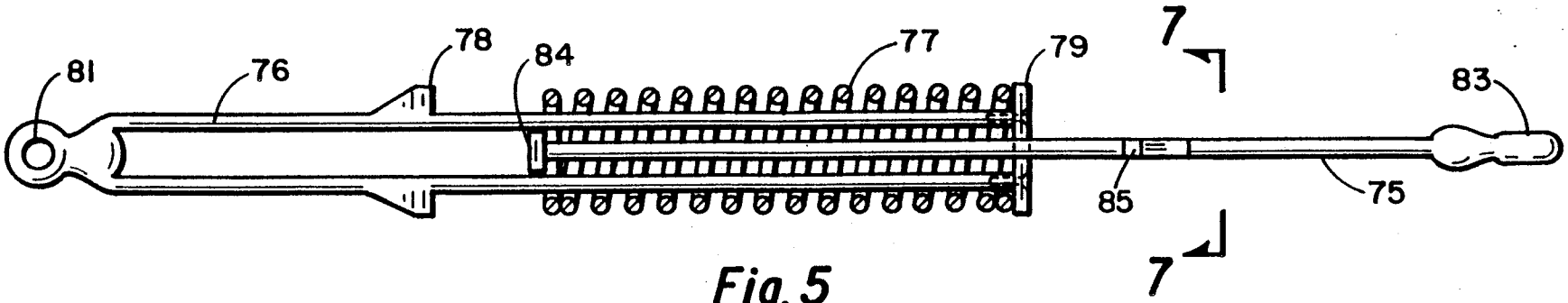
FIG. 5 is a cross-section of the spacer illustrated in FIG. 4 showing the spacer in the expanded position.
Figure 4:
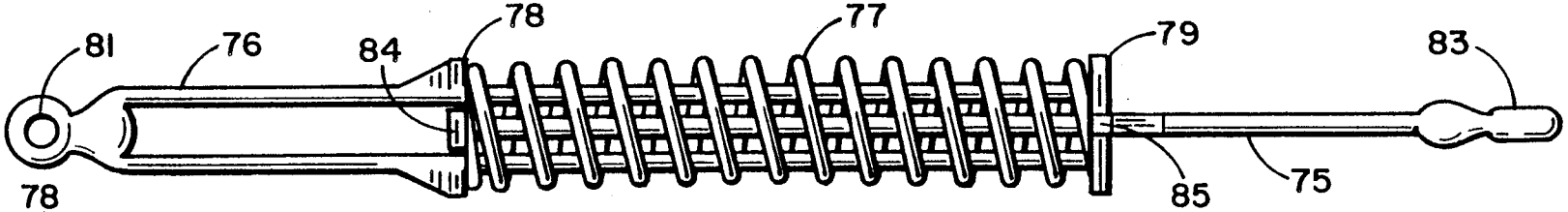
FIG. 4 is an elevational view of a spring loaded dock spacer for use with the boat lift illustrated in FIGS. 2 and 3 showing the spacer in the relaxed position.
Figure 6:
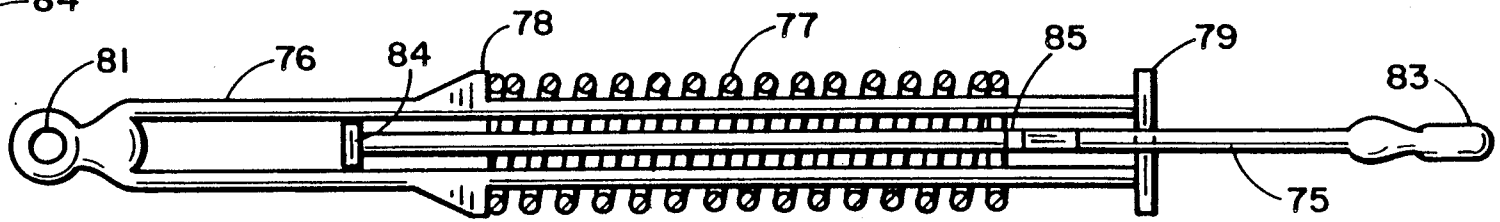
FIG. 6 is a cross-section of the spacer illustrated in FIG. 4 showing the spacer in the compressed condition.
Figure 7:
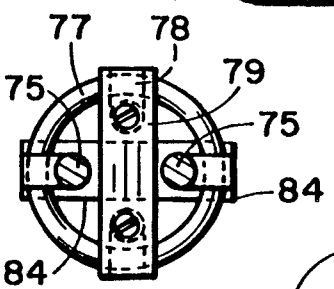
FIG. 7 is a cross-section of the spacer illustrated in FIG. 5 taken along the lines 7—7.

The boat lift 10 may be connected to a dock 70 or may be used in conjunction with a mooring system if no dock is available. When used in conjunction with the dock 70 as shown, the mounting system includes a pair of cables 71 and 72 which connect the forward portion of the dock 70 to the rear of the cradle 20 (or one of the pontoons, as shown) and the rear portion of the dock 70 to the forward portion of the cradle 20 (or one of the pontoons, as shown) in the conventional docking fashion. To keep the lift 10 and the boat 60 a safe distance from the dock 70, a pair of spring loaded spacers 73 and 74 may be fixed between the dock 70 and the cradle 20 at the forward and rearward ends of the cradle 20. The spring loaded spacers 73 and 74 found most suitable for this purpose are illustrated in FIGS. 4 through 7. They consist essentially of a spring biased reciprocating rod 75 and housing 76. In the normal condition illustrated in FIG. 4, a coil spring 77 is axially mounted along one end of the housing 77 and is relaxed between a dockside seat 78 and a boatside seat 79 on the housing 76. The other end of the housing 76 is connected to a pivot mount 80 on the dock 70 through a dockside eyelet 81. The free end of the rod 75 is connected to a pivot mount 82 on the lift 10 through a boatside eyelet 83. These connections may be accomplished in any suitable fashion accommodating variations in the angular relationship of the spacers 73 and 74 to the dock 70 and the lift 10 resulting from changes in water level. As shown in FIG. 5, as external forces such as wind shift the lift away from the dock 70, the rod 75 is gradually withdrawn from the housing 76. A dockside plate 84 mounted on the end of the rod 75 within the housing 76 causes the spring 77 to be compressed against the boatside seat 79, thus biasing the rod 75 against further withdrawal. As shown in FIG. 6, as external forces shift the lift 10 toward the dock 70, the rod 75 penetrates into the housing 76, abutting a boatside plate 85 with the spring 77 and causing the spring 77 to be compressed against the dockside seat 78, thus biasing the rod 75 against further penetration into the housing 76.

It is preferred, as can be seen from the following explanation, that, in the operation of the lift 10, the rear portion of the cradle 20 should be lowered more quickly than the forward portion. This is achieved by the location of the water vents 33 and 34 and air vents 37 and 38 in the pontoons 21 and 22. During the operation of the lift 10, the lift 10 will be lowered by maintaining the pontoon air vents 37 and 38 in the open condition and allowing water to fill the pontoons 21 and 22 through the water vents 33 and 34. Since the water enters the rear portion of the pontoons 21 and 22, the rear portion of the cradle 20 will be lowered more quickly than the forward portion, allowing the boat 60 to be more easily driven into place on the cradle 20. This also takes advantage of the weight of the boat 60 in flooding the air vent ends of the pontoons 21 and 22. Conversely, if the boat 60 is being removed from the lift 10, the rear of the pontoons 21 and 22 will likewise be lowered more quickly, thus allowing the heavier stern of the boat 60 to experience buoyancy more quickly than the bow and facilitating withdrawal of the bow of the boat 60 from the cradle 20.

It is also essential that the cradle 20, insofar as possible, be laterally stable despite any imbalanced weight distribution in the boat or lift, any external forces on the boat or lift caused by waves or wind or any unequal rates of filling or evacuation of the pontoons 21 and 22.

A lift control system 100 is encased within the control enclosure 41 which, in a first mode of operation, selectively activates and deactivates the raising and lowering of the lift 10 and, in a second mode of operation, automatically regulates the lateral attitude of the lift 10. This dual mode control system 100 will hereinafter be explained.

The lift control system 100 mounted within the control enclosure 41 is illustrated in FIGS. 8 through 21. The enclosure 41 itself is not shown in any of these figures but portions of an internal frame 101 to which the various components of the control system 100 are attached are illustrated.

Figure 8:
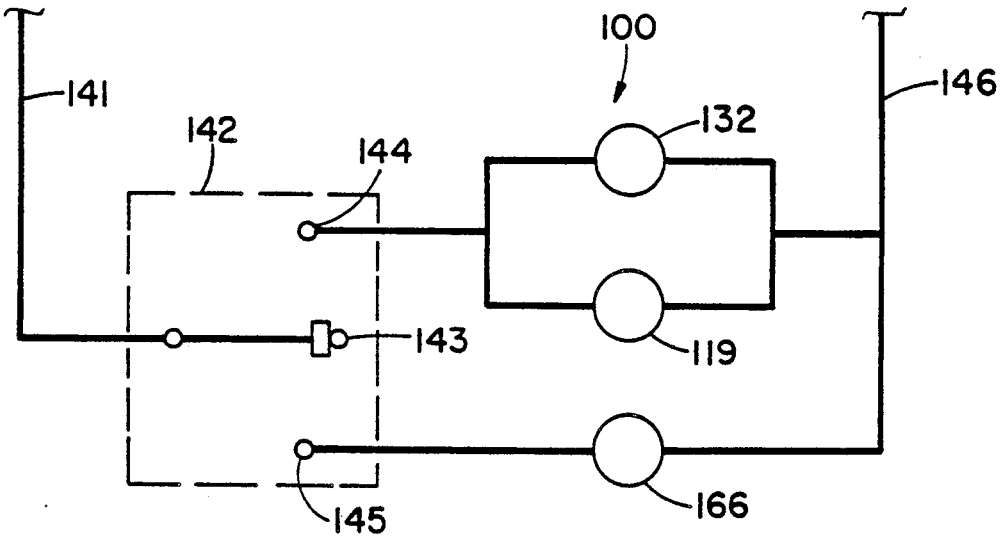
FIG. 8 is a schematic diagram of the electrical components of the boat lift control system.
Figure 9:
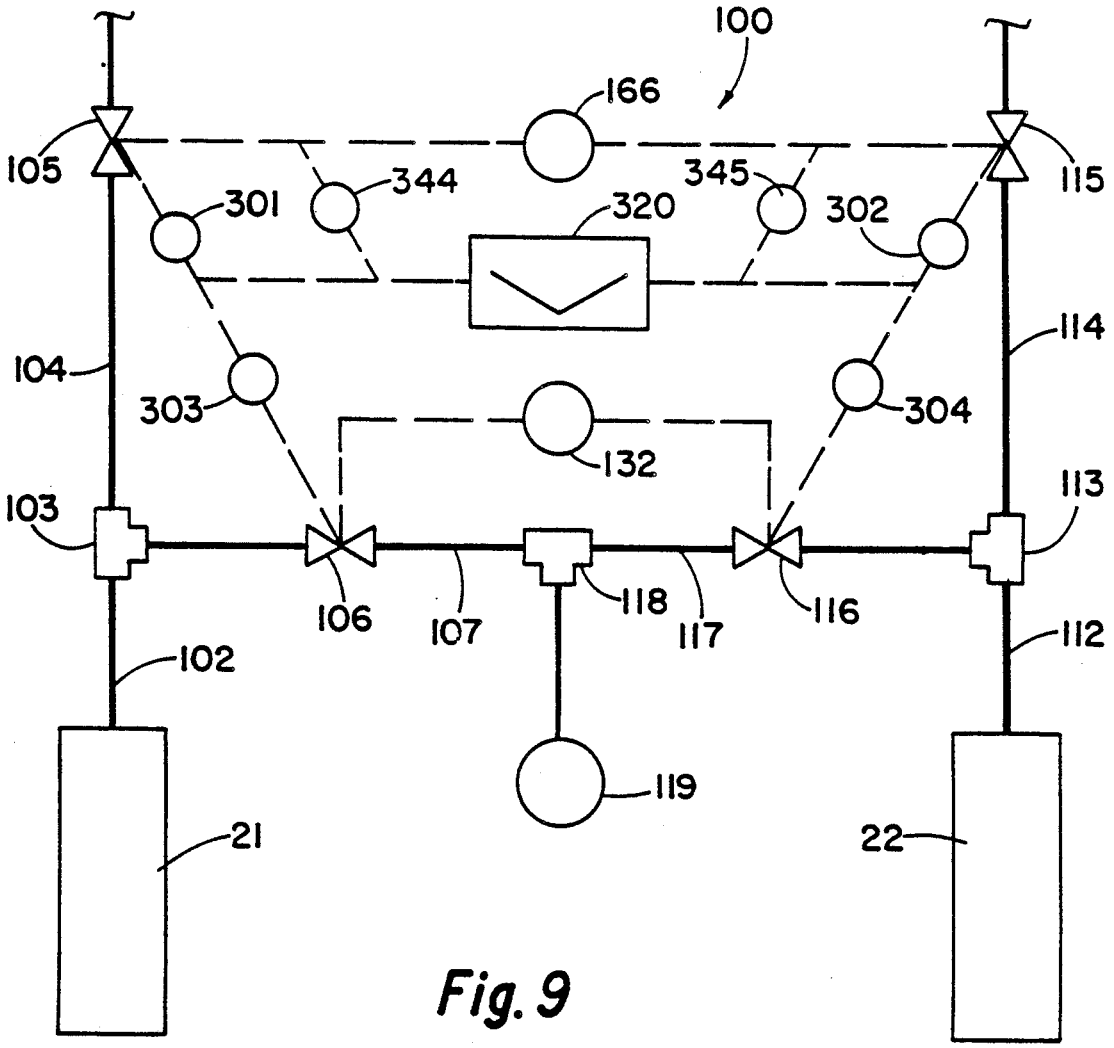
FIG. 9 is a schematic diagram of the mechanical components of the boat lift control system.
Figure 10:
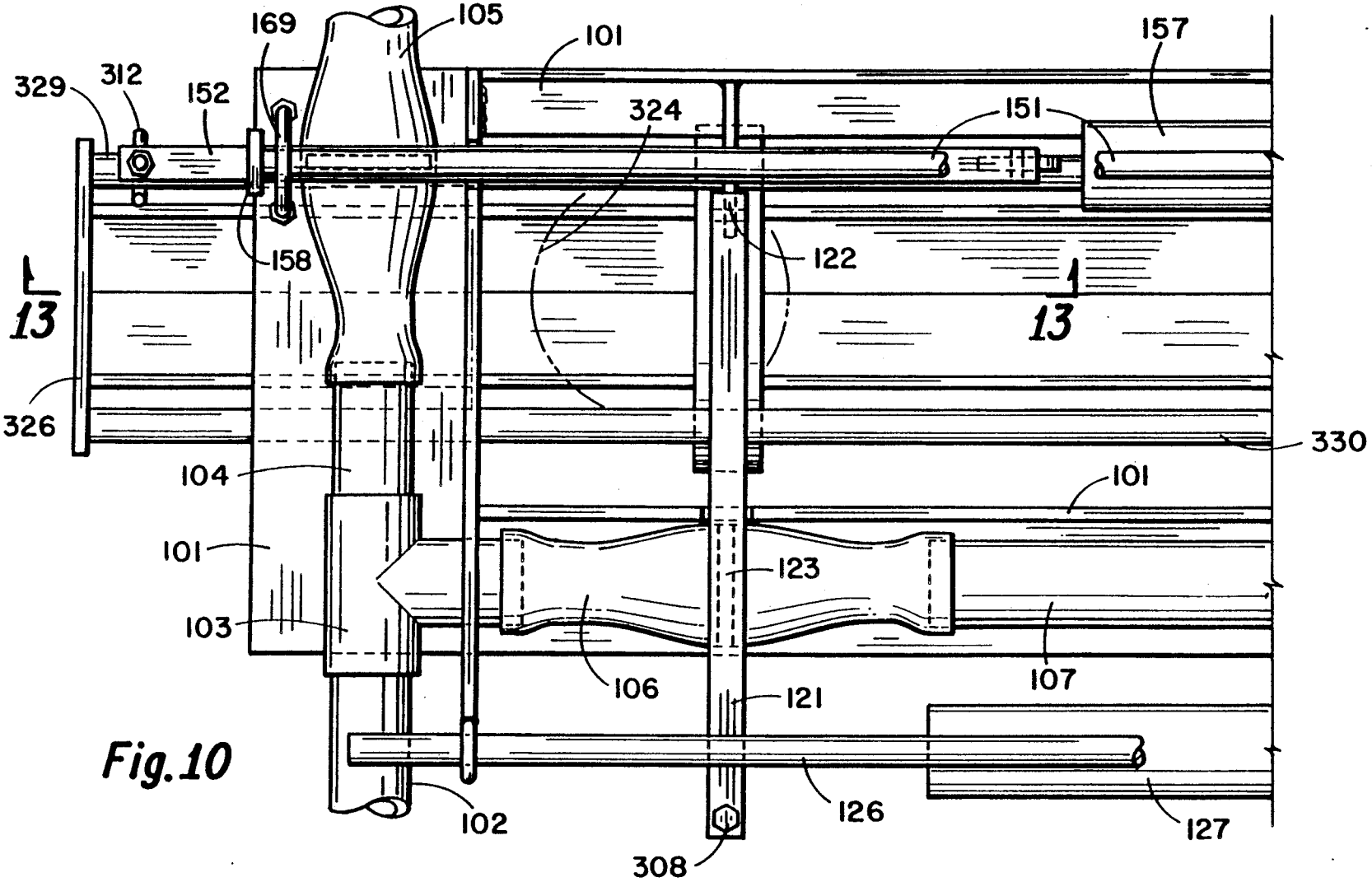
FIG. 10 is a plan view of the portside components of the leveler control system.
Figure 11:
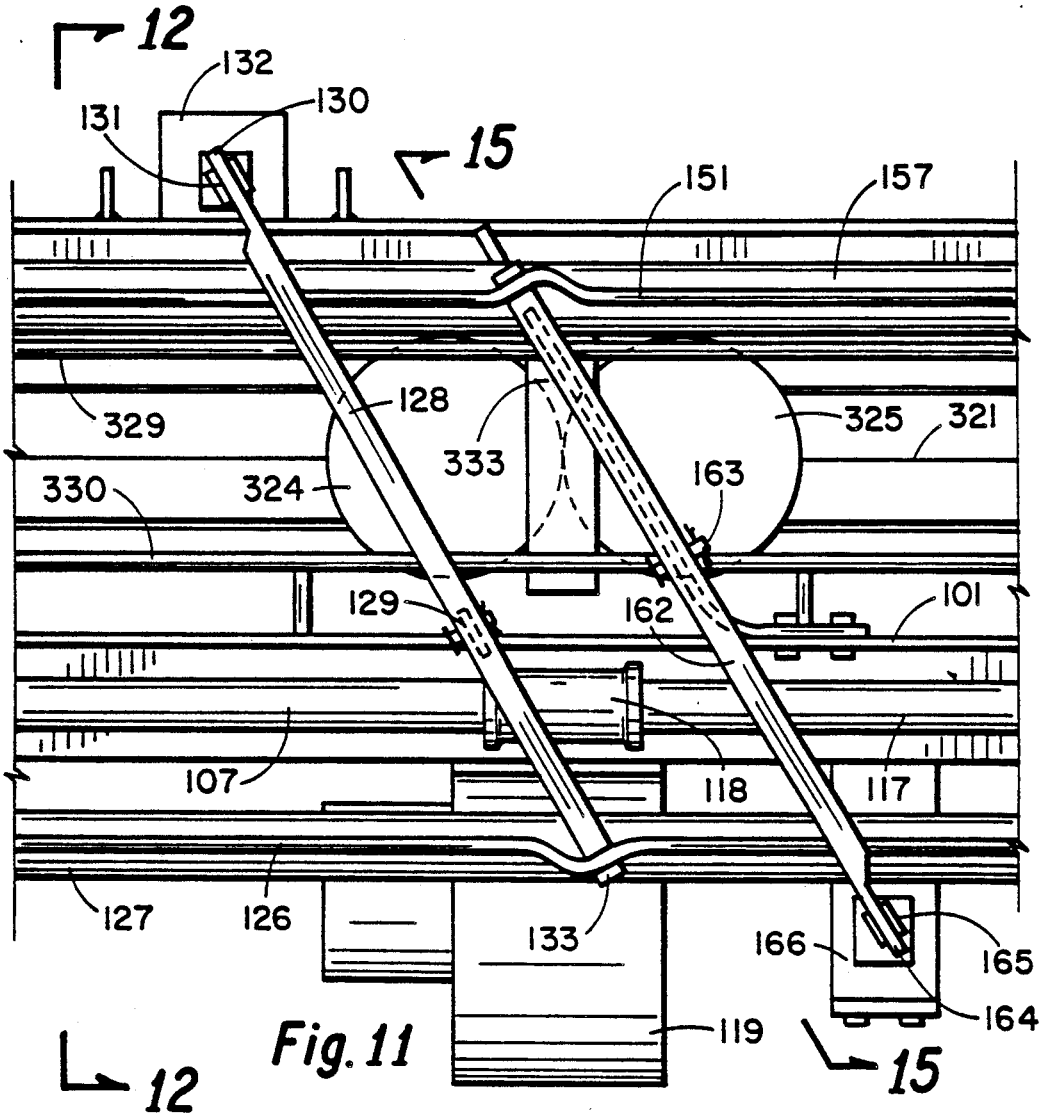
FIG. 11 is a plan view of the central components of the leveler control system.
Figure 15:
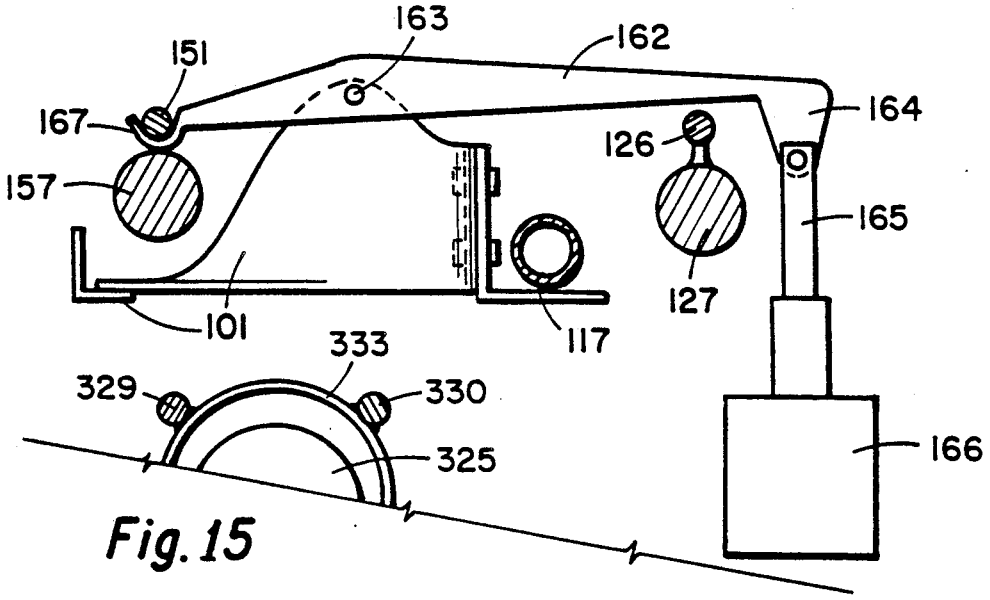
FIG. 15 is a sectional view taken along lines 15–15 of FIG. 11.
Figure 12:
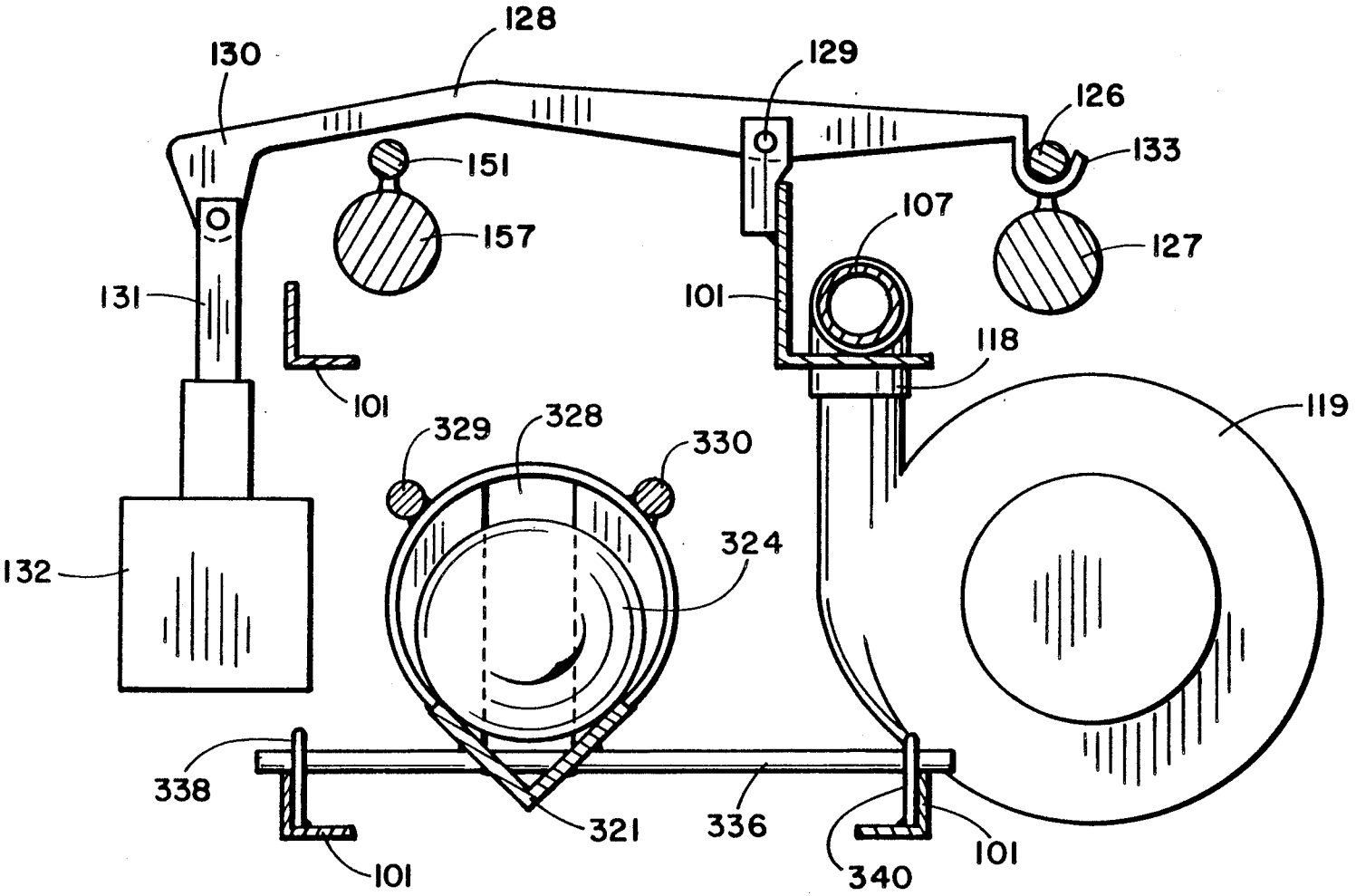
FIG. 12 is a cross-section taken along the lines 12–12 of FIG. 11.

The air flow components of the lift control system 100 can best be understood by reference first of all to FIGS. 8 and 9 which illustrate the control system 100 schematically and to FIG. 10 which illustrates the port pontoon components. A first conduit 102 extends into the enclosure 41 from the rear air duct 45 of the enclosure 42 and is connected to one arm of a T-member 103. The other arm of the T-member 103 is connected via a port exhaust line 104 to a port exhaust valve 105 which vents through the air vent 49 in the enclosure 41 to the atmosphere. The leg of the T-member 103 is connected to a port intake valve 106 which is in turn connected to an air intake line 107. When the port exhaust valve 105 and the port intake valve 106 are closed, the air to water ratio of the port pontoon 21 is stabilized. When the port intake valve 106 is closed and the port exhaust valve 105 is opened to the atmosphere, air will be released from the pontoon 21 to the atmosphere and water permitted to enter the pontoon 21 through the water vent 33. When the port exhaust valve 105 is closed and the port intake valve 106 is opened, then air can be admitted under pressure through the air intake line 107 to the pontoon 21 and water will be evacuated through the water vent 33.

The air flow components for the starboard pontoon 22 are arranged in an opposite hand configuration of the port pontoon components above described, including conduit 112, T-member 113, starboard exhaust line 114, starboard exhaust valve 115, starboard intake valve 116 and air intake line 117. As can best be seen in reference to FIGS. 11 and 12, the port air intake line 107 and the starboard air intake line 117 are connected to the arms of a T-section 118, the leg of which is connected to a blower 119 which provides the necessary air pressure for operation of both the port and starboard pontoons 21 and 22. The air intake pipes 53 and 54 illustrated in FIGS. 1 and 2 provide a source of air for the blower 119.

In the preferred embodiment illustrated in the drawings, the intake and exhaust valves 105, 106, 115 and 116 for both the port and starboard pontoons 21 and 22 consist of a resiliently flexible section of tubing which normally rests in the open condition but which can be pinched to block the flow of air through the valve.

Figure 13:
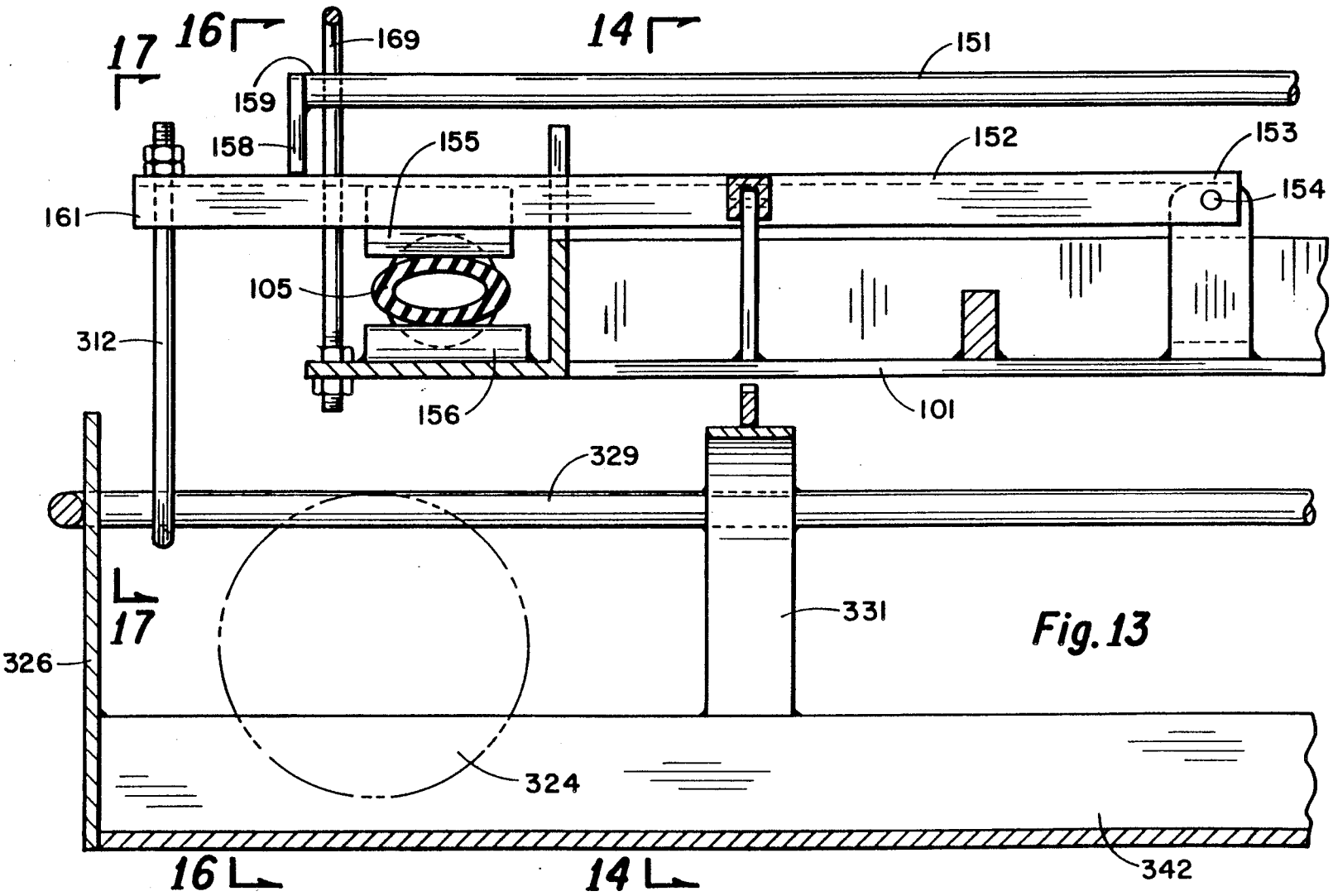
FIG. 13 is a sectional view taken along the lines 13–13 of FIG. 10.
Figure 14:
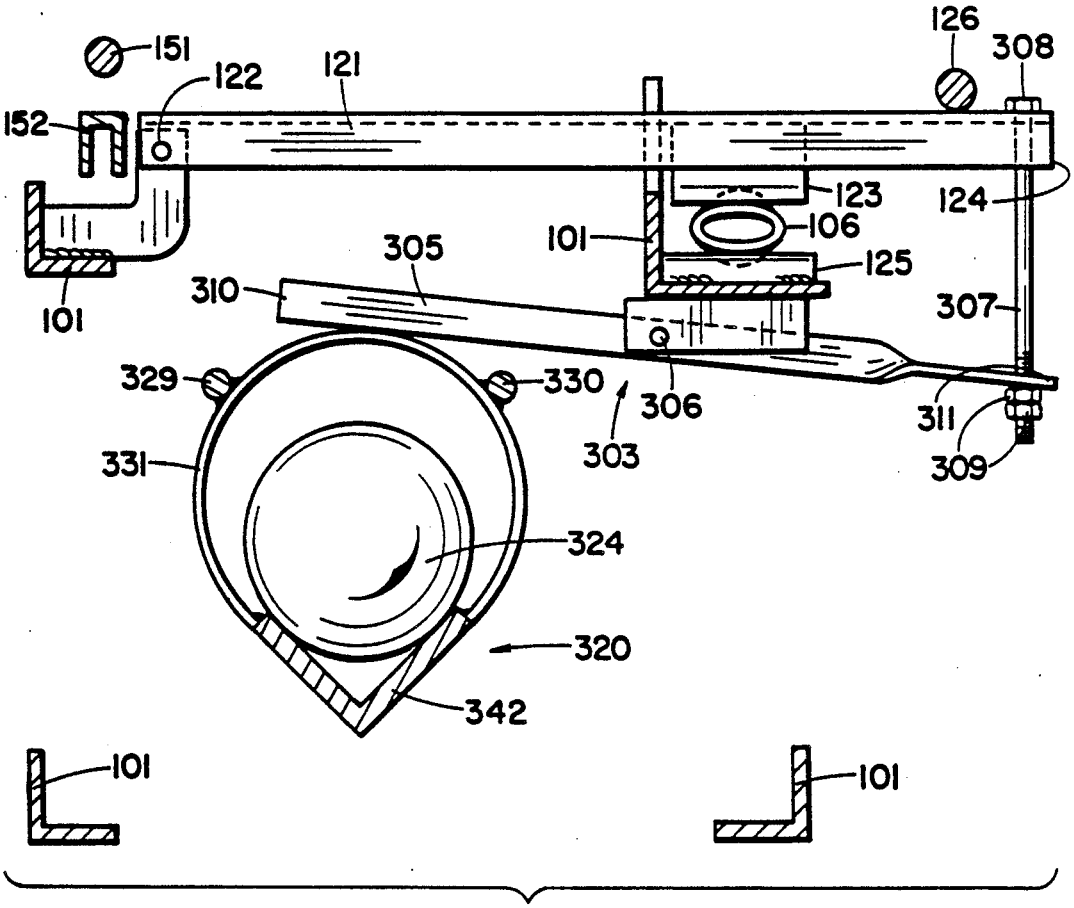
FIG. 14 is a sectional view taken along the lines 14–14 of FIG. 13.

The mechanical components employed in the first mode of operation of the port pontoon control system are also illustrated in FIGS. 13 and 14. Looking first to the port intake valve system illustrated in FIG. 10, the port intake valve 106 is opened and closed by a valve lever 121 which is pivotally mounted at one of its ends 122 to a member of the leveler control frame 101. The lever 121 extends transversely across the tubular valve 106 and the valve 106 lies between an upper pinching member 123 fixed proximate the free end 124 of the lever 121 and a lower pinching member 125 fixed to the leveler control frame 101. As shown in FIGS. 10 and 14 an intake control rod 126 extends lengthwise within the control enclosure 41 and extends above and transverse to the free end of the port intake valve lever 121 and its starboard counterpart (not shown). The intake control rod 126 is downwardly biased by an intake weight rod 127 fixed beneath the intake control rod 126. Thus, without the exertion of other forces, the port intake valve 106 will be normally closed by the weight of the rod 127 which is sufficient to overcome the flexible resiliency of the valve 106 and to close the pinchers 123 and 125. Looking at FIGS. 11 and 12, the port intake control rod 126 is seen to be responsive to an air intake actuating lever 128 which is mounted to the frame 101 at an intermediate pivot 129. One end 130 of the actuating lever 128 is connected to the plunger 131 of an air intake solenoid 132. The other end of the actuating lever 128 terminates in a hook 133 in which the intake control rod 126 rests.

The electrical system associated with the first mode of operation of the lift control is illustrated in FIG. 8. An incoming power line 141 is connected to a three way selector switch 142 having an off terminal 143, an intake terminal 144 and an exhaust terminal 145. The solenoid 132 and the blower 119 are connected in parallel between the intake terminal 144 and a circuit outlet line 146. When the selector switch 142 is set in the intake position 144, the solenoid 132 is energized, pulling the plunger 131 in a downward direction and causing the intake actuating lever 128 to pivot about the pivot point 129, thus raising the hook 133, the air intake control rod 126 and the intake weight rod 127. When the weight rod 127 is lifted, its downward force is withdrawn from the port intake valve lever 121 and the pinchers 123 and 125 and their starboard counterparts, thus permitting the resilient intake valves 106 and 116 to flex to the open condition. It should be noted that the starboard counterparts are responsive to the same solenoid 132 and intake control rod 126 as the port components. Simultaneously, the energized blower 119 forces air through the T-section 118 into the port intake valve 106 and the starboard intake valve 116 and thus to the pontoons 21 and 22.

The air exhaust components of the first mode of operation of the lift control 100 operate somewhat similarly. As shown in FIGS. 10 and 13, an exhaust control rod 151 extends lengthwise in the control enclosure 41 above and across the midpoints of the port exhaust valve 105 and the starboard exhaust valve 115 (not shown). A port exhaust valve lever 152 has one end 153 pivotally connected at 154 to the control frame 101 and extends beneath the exhaust control rod 151 transversely across the valve 105 at its midpoint. The port exhaust valve 105 lies between an upper pincher 155 which extends downwardly from the valve lever 152 and a lower pincher 156 which extends upwardly from the control frame 101. The exhaust control rod 151 has a weight rod 157 fixed beneath it, a downwardly turned flange 158 at its port end 159 and a similar flange on its starboard end (not shown). The exhaust control rod 151 is sufficiently long so that the downwardly turned flange 158 and its counterpart can engage the upper surfaces of the exterior ends 161 of the port exhaust valve lever 152 and its starboard counterpart (not shown). Looking at FIGS. 11 and 15, an air exhaust actuating lever 162 is pivoted on the control frame 101 at pivot point 163. One end 164 of the exhaust actuating lever 162 is fixed to the plunger 165 of an exhaust solenoid 166. The other end of the exhaust actuating lever 162 is terminated in a hook 167 which supports the exhaust control rod 151 and therefore the weight rod 157. The port exhaust valve 105 and the starboard exhaust valve 115 are normally held in the closed condition by the downward force of the weight rod 157 and the control rod 151 which squeezes the flexible valves 105 and 115 between the pinchers 155 and 156 and their starboard counterparts. Looking again to FIG. 8, when the selector switch 142 is set in the exhaust position 145, the exhaust solenoid 166 is energized. This causes the plunger 165 to be pulled downwardly, pivotally lifting the exhaust control rod 151 and the weight rod 157. When the control and weight rods 151 and 157 are lifted, the port exhaust valve pinchers 155 and 156 and their starboard counterparts (not shown) are opened, allowing the resilient exhaust valves 105 and 115 to open. Thus, air is released from the pontoons 21 and 22 through their respective exhaust valves 105 or 115 to the atmosphere, allowing water to enter into the pontoons 21 and 22.

Figure 16:
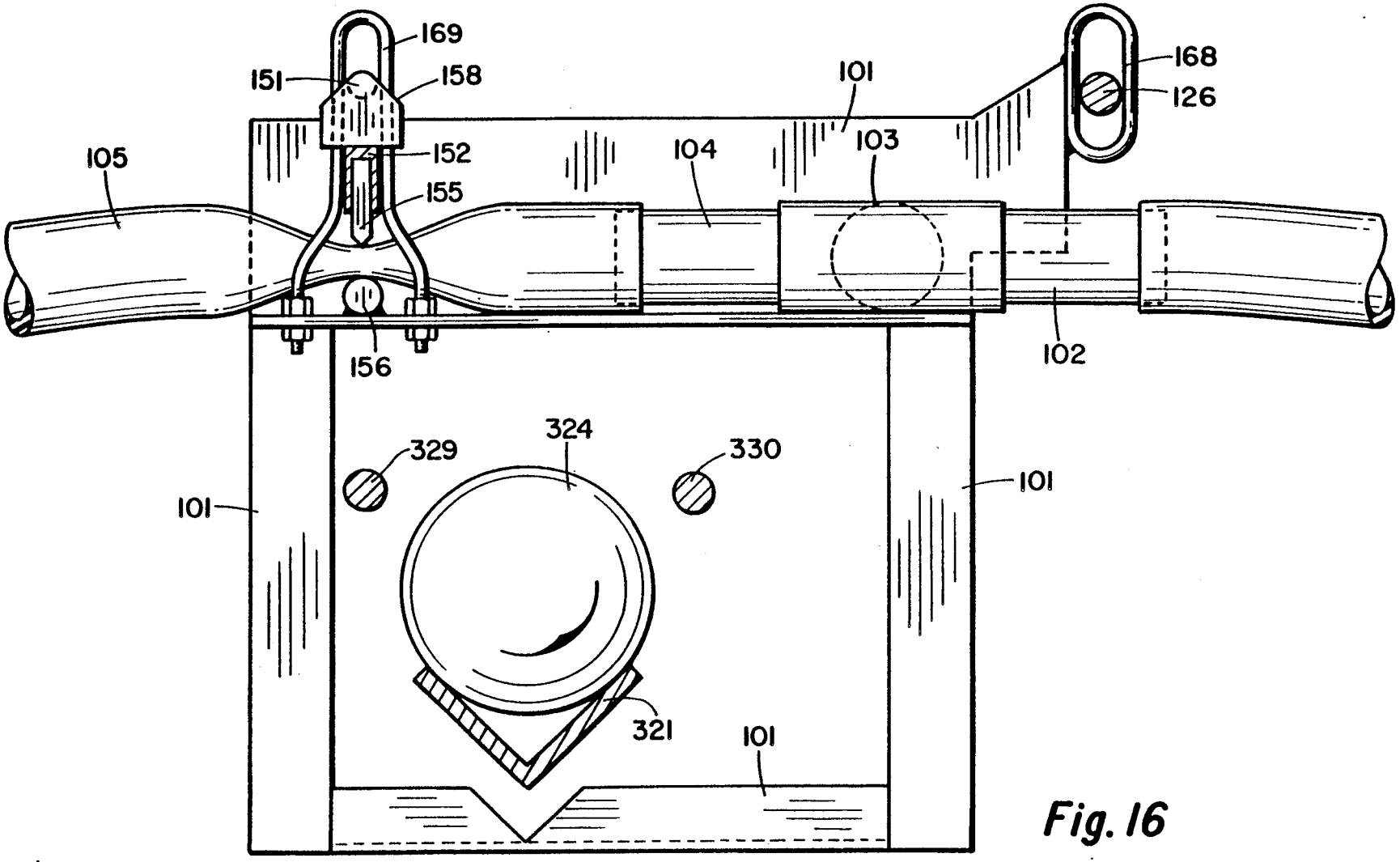
FIG. 16 is a sectional view taken along the lines 16–16 of FIG. 13.

As can best be seen in FIG. 16, intake control rod guides 168 and exhaust control rod guides 169 may be mounted on the control frame 101 to assure that the intake and exhaust control rods 126 and 151 will be maintained in a proper attitude above their respective valves.

Thus, the first mode of operation of the lift control system 100 is basically mechanical but is selectively electrically activated by the switch 142 which may be mounted on the dock 70 or other desired location, including the lift 10 itself, and may easily be made secure in any of a multitude of ways. The switch may be remotely operated. When the switch 142 is in the "off" position 144, all valves are closed and the lift 10 remains in its existing position. When the switch 142 is in the "intake" position 143, the air intake valves 106 and 116 are open and the blower 119 is energized, filling the pontoons 21 and 22 with air to raise the lift 10. When the switch 142 is in the "exhaust" portion 145, the air exhaust valves 105 and 115 are open, permitting the pontoons 21 and 22 to be filled with water to lower the lift 10.

The first mode of operation of the lift control system 10 above described affords no coordination between the components of the port and starboard pontoons 21 and 22. Both pontoons will be constantly filling or evacuating until the selector switch 142 is set to the off position 143 to deactivate the operation of the system 100. However, due to various conditions of wind, current, weight distribution or air flow, the lateral attitude of the lift 10 could assume an undesirable degree of list during operation. In order to coordinate the operation of the system 100 to maintain the lift 10 within desirable limits of list, a mechanical override system as illustrated in FIG. 9 is provided. This override system includes a port exhaust override mechanism 301, a starboard exhaust override mechanism 302, a port intake override mechanism 303 and a starboard intake override mechanism 304. If the selector switch is in the intake position 144, the intake solenoid 132 and the blower 119 are energized, opening the intake valves 106 and 116 and forcing air into the pontoons 21 and 22. If either pontoon 21 or 22 is rising significantly faster than the other, the appropriate intake override mechanism 303 or 304 operates to close the air intake valve 106 or 116 of that pontoon until the list of the lift 20 is reduced to acceptable limits. Similarly, when the switch 142 is in the exhaust position 145 and the exhaust solenoid 166 is energized, the exhaust valves 105 and 115 are opened to evacuate air as water fills the pontoons 21 and 22. If either pontoon 21 or 22 becomes significantly lower than the other during the course of operation, the appropriate exhaust override mechanism 301 or 302 closes the exhaust valve of the lower pontoon to prevent further infilling of that pontoon with water until the list of the lift 10 is again within acceptable limits.

The mechanical operation of an intake override mechanism 303 and 304 can best be seen in FIG. 14 which illustrates the port intake override mechanism 303. The mechanism 303 includes an override lever 305 which is pivotally connected at a point 306 along the inner portion of its length to the lift control frame 101. The override lever 305 extends beneath the valve lever 121 and the free end of the valve lever 124 is connected to the override lever 305 by a link 307 which, as illustrated, may consist of a bolt 308 extending downwardly through holes provided in the valve lever 121 and the override lever 305 to one or more nuts 309 which may be used to adjust the distance between the ends of the valve lever 121 and the override lever 305. Thus, when the valve 106 is open, an upward force on the free end 310 of the override lever 305 will cause the valve lever 121 to be pulled downwardly, thus shutting the valve 106. It should be noted that the connected end 311 of the override lever 305 is free to ride upwardly on the link 307 so as not to be able to override the closing of the valve 106. The starboard intake override mechanism 304 is an opposite hand embodiment of the port side mechanism 303. The means for providing an upward force to the unconnected end 310 of the override lever 305 will be hereinafter described.

Figure 17:
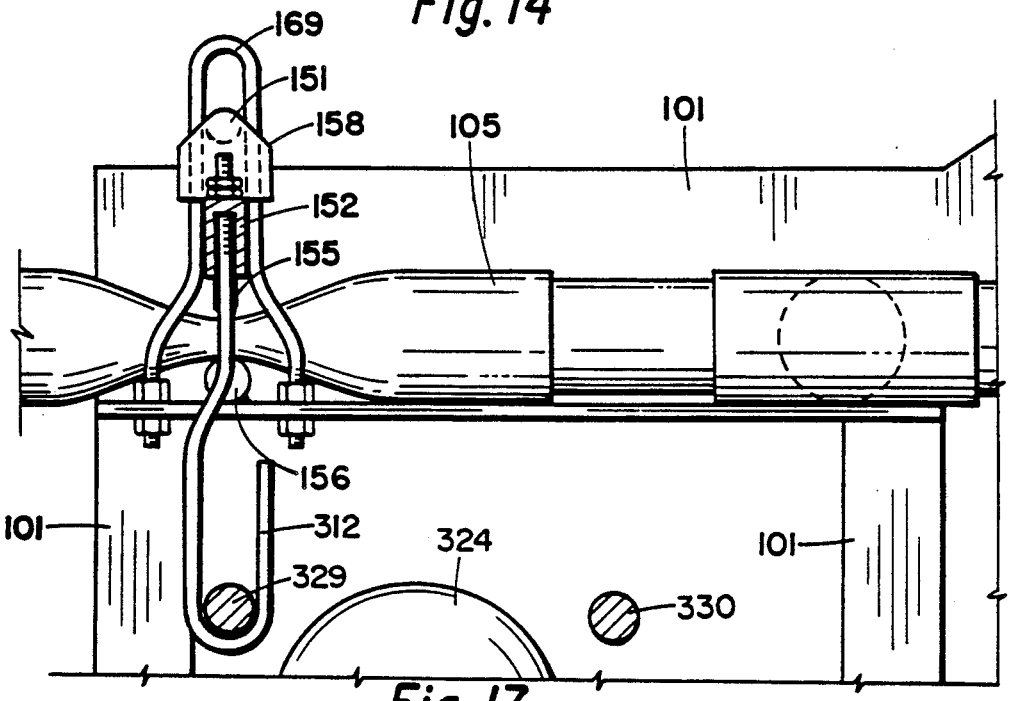
FIG. 17 is a sectional view taken along the lines 17–17 of FIG. 13.

The exhaust override mechanisms 301 and 302 can best be understood by reference to FIGS. 13 and 17 which illustrate the port exhaust override mechanism 301. A topwardly open hook 312 extends downwardly from the port exhaust valve lever 152. When the port exhaust valve 105 is in the open condition, a downward force exerted upon the hook 312 will cause the port exhaust valve lever 152 to be downwardly pulled, thus closing the port exhaust valve 105 between the pinchers 155 and 156. The starboard exhaust override mechanism 302 is an opposite hand arrangement of this port exhaust override mechanism 301.

Figure 18:
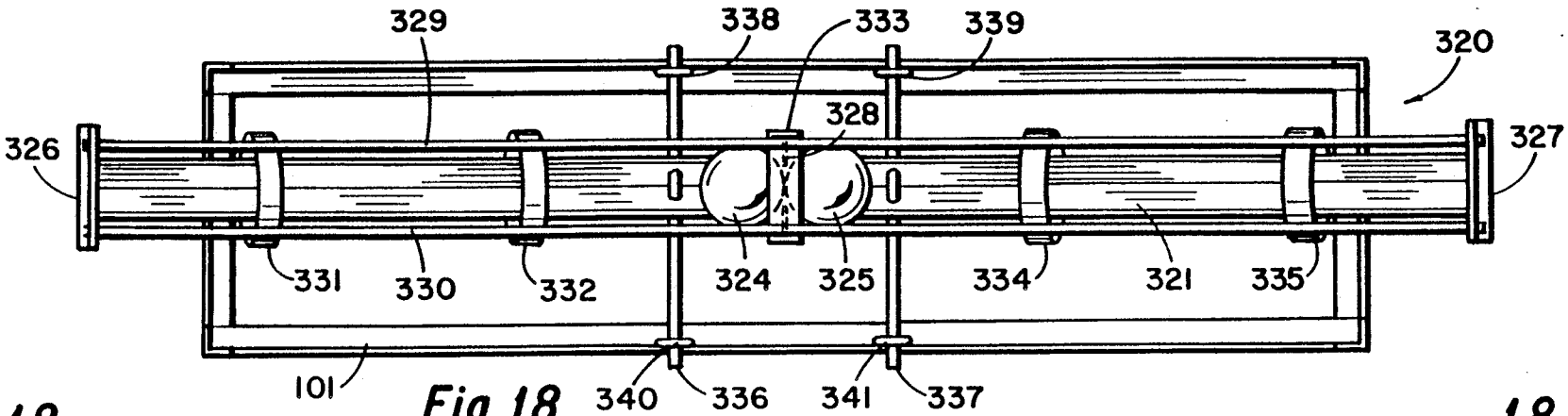
FIG. 18 is a plan view of the mechanical switching device of the automatic leveling apparatus of the boat-lift.
Figure 19:
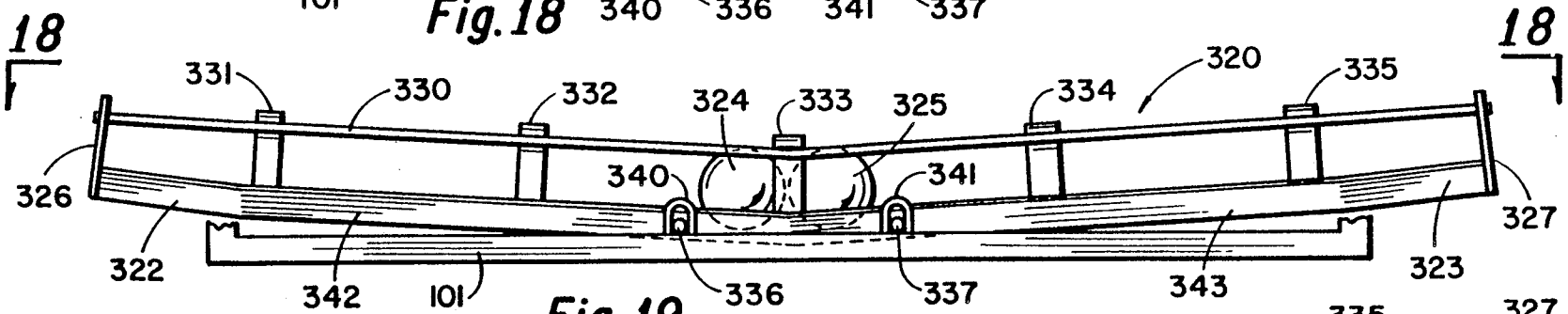
FIG. 19 is an elevation of the apparatus of FIG. 18 illustrating the switch in the balanced position.
Figure 20:
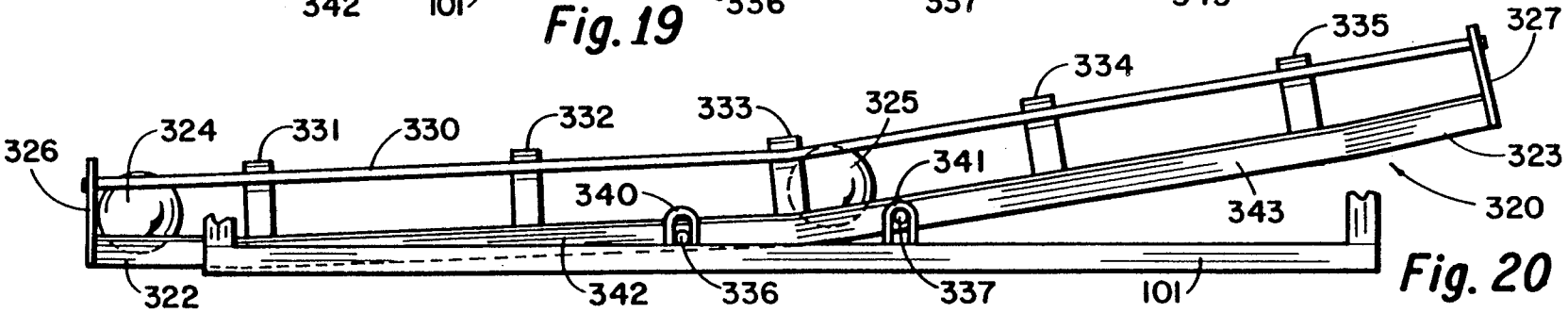
FIG. 20 is an elevation of the apparatus of FIG. 18 illustrating the switch in response to a port list of the lift.

The same apparatus that activates the intake override mechanisms 303 and 304 activates the exhaust override mechanisms 301 and 302 and can be most easily understood in reference to FIGS. 18, 19 and 20. The mechanical switching apparatus 320 consists of a V-shaped track 321 having a V cross-section, the arms of the V-shaped track being set at a predetermined angle as will be hereinafter understood. Preferably its outer ends 322 and 323 more steeply sloped than its intermediate portions. Comparatively heavy port and starboard balls 324 and 325 are disposed within the channel 321. End plates 326 and 327 and center plate 328 are provided on the channel 321 to restrict the travel of each ball 324 or 325 to its respective arm of the V-shaped channel 321. A pair of retaining rods 329 and 330 in V-shaped configuration substantially parallel to the interior portion of the V-shaped track 321 extend between the plates 326 and 327 to assure that the balls 324 and 325 do not leave the track 321. This assembly is reinforced by circular straps 331 through 335 which may be welded to the track 321 and the rods 329 and 330. The channel 321 is provided with a port fulcrum pin 336 and a starboard fulcrum pin 337 which extend transversely through the track 321 at small equal distances from the center of the track 321. The fulcra 336 and 337 are supported on their ends by the lift control frame 101 and are held in place by U-shaped clamps 338 through 341 which may be welded to the frame 101. The frame 101 is secured within the control enclosure 41 and the V-shaped track 321 is set on the frame 101 so that the track 321 is in its upright or balanced position when the lift 10 is in a laterally balanced condition, that is when there is no list. As the lift 10 lists to port or starboard, track 321 will tilt accordingly. While both the port arm 342 and the starboard arm 343 of the track 321 remain above the horizontal, their respective ball 324 or 325 will rest at the center plate 328 of the V-shaped track 321. As the list 10 lifts to either side, one of the arms 342 or 343 may rotate below horizontal. This will occur at a predetermined angle of list as above referred to. When this happens, if the lift 10 lists to port, the port ball 324 will begin to roll toward the port end plate 326 at the now lower port extremity of the track 321. When the ball 324 rolls far enough to counterbalance the weight of the track 321, the track 321 will pivot about the low side fulcrum 336. If the track 321 remains pivoted about the fulcrum 336 for a sufficient length of time, the ball 324 will travel to the outer extremity of its port arm 342 into contact with its respective end plate 326 as is shown in FIG. 20. As the lift 10 returns to a degree of list that is within acceptable limits, the port arm 342 of the track 321 will again pass through the horizontal. As this occurs, the more steeply angled end 322 provides added impetus in returning the ball 324 to the center of the V-shaped track 321, thus increasing the sensitivity of the apparatus. If the lift 10 lists to starboard, the apparatus 320 operates in opposite fashion.

This mechanical switching apparatus 320 is used to operate the override mechanisms 301 through 304 in a fashion that can best be seen in relation to FIGS. 14 and 17. In FIG. 14, the port intake override mechanism 303 is illustrated in relation to the switching apparatus 320. As shown, the port side ball 324 is set in the port side arm 342 of the track. The retaining rods 329 and 330 contain the ball 324 on the track. The circular strap 331 which reinforces the rods 329 and 330 is seen to serve a dual purpose. The strap 331 is vertically aligned beneath the free end 310 of the port override lever 305. The position of the nut 309 on the connector 307 is established so that, when the starboard or opposite side arm (not shown) of the V-shaped member rotates downwardly about its fulcrum 337, the port arm 342 is raised, causing the strap 331 to drive the free end 310 of the lever 305 upwardly, thus closing the port side intake valve 106. With this valve 106 closed, all of the air from the blower 119 will be pumped into the starboard side pontoon 22 until the starboard pontoon 22 rises to the necessary level to return the apparatus 320 to the balanced position shown in FIG. 19. When this happens, the upward force on the free end 310 of the lever 305 is removed and the valve 106 resiliently returns to the open condition, again permitting air to be pumped into both pontoons 21 and 22. The starboard intake override mechanism 304 operates in similar fashion.

The port exhaust override mechanism 301 is shown in FIG. 17. The ball retaining rod 329 of the apparatus 320 slides vertically within the topwardly open hook 312 which is connected to the port exhaust valve lever 152. During the exhaust cycle, if the portside pontoon 21 is lower than the starboard side pontoon 22 to an unacceptable degree, the movement of the port side ball 324 toward the port extremity 326 of the V-shaped track 321 causes the mechanism 320 to rotate about the port fulcrum 336 and thus move the retaining rod 329 in a downward direction. The length of the hook 312 is established so that, as this occurs, the retaining rod 329 exerts a downward force on the hook 312 pulling the port exhaust lever 152 to close the port exhaust valve 105, blocking the flow of air through the valve 105 and preventing additional water from entering the portside pontoon 21. As water continues to enter the starboard side pontoon 22, the lift 10 will again return to acceptable limits of list and the apparatus 320 will return to the balanced condition as hereinbefore explained. When this occurs, the retaining rod 329 will slide upwardly within the hook 312, ending the downward force on the hook 312 and releasing the valve 105 to resiliently return to the open condition, thus allowing water to again enter both pontoons 21 and 22.

The starboard exhaust override mechanism 302 is in all respects operated similarly to the port exhaust override mechanism 301 as hereinbefore explained.

The above exhaust override mechanisms 301 and 302 operate to stabilize the lift during the lowering process by overriding the exhaust condition of the electrical system which, through the exhaust solenoid 166, holds the exhaust valves 105 and 115 open during the lift lowering process. It is also desirable, however, to stabilize the lift when it rests in the storage condition, that is, when the switch 142 is in the off position 143. For example, if a leak were to develop in the pneumatic system of either pontoon, that pontoon would fill with water and be lowered until the lift reached an extreme degree of list or even capsized. To prevent this, additional exhaust override mechanisms 344 and 345 are provided which respond to the ball operated switching mechanism 320 to slightly open either exhaust valve 105 or 115 to bleed off air from the high side pontoon. Thus, if the pneumatic system of one pontoon fails, the exhaust valve of the other pontoon will be intermittently opened to balance the loss of air and gradually lower the entire lift to its lowest position.

Figure 21:
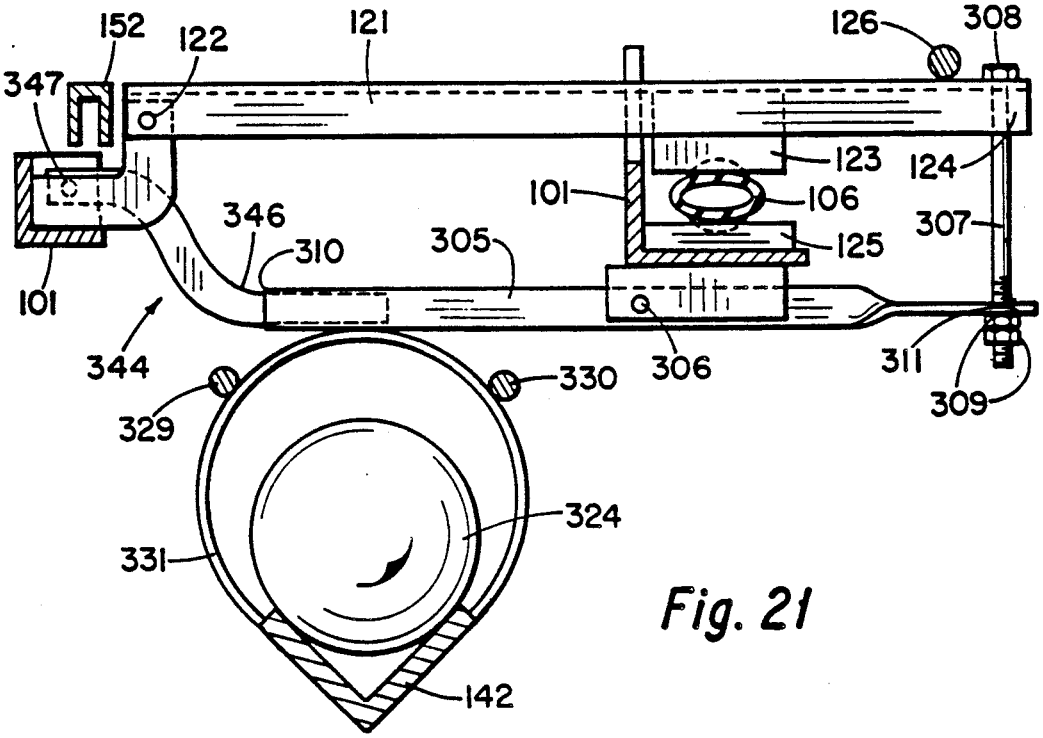
FIG. 21 is a sectional view taken along the lines 21–21 of FIG. 13.

The mechanical operation of the bleeder override mechanisms 344 and 345 can be understood by reference to FIG. 21 which illustrates the port bleeder override mechanism 344. When the mechanical apparatus 320 rises on the port side, it not only lifts the lever 305 as hereinbefore explained, but simultaneously slightly lifts another lever 346 about its pivot 347 which in turn slightly lifts the port exhaust valve lever 152. This action opens the port exhaust valve 105 slightly, letting a small amount of air bleed from the high port pontoon 21. This feature also enhances the responsiveness of the automatic leveling system during the lifting operation because it bleeds the high pontoon thus augmenting the benefit of closing the high pontoon intake valve.

The starboard bleeder override mechanism 345 is an opposite hand replica of the port mechanism 344.

Thus, it is apparent that there has been provided in accordance with the invention a boat lift and leveler that fully satisfy the objects, aims and advantage set forth above. While the invention has been described in conjunction with the specific embodiment thereof, it is evident that many alternatives, modifications and variations will be apparent to those skilled in the art in light of the foregoing description. Accordingly, it is intended to embrace all such alternatives, modifications and variations as fall within the spirit of the appended claims.

What is claimed is:

1. For use with a boat lift having a cradle lifted or lowered by the respective introduction into or evacuation from lateral pontoons supporting the cradle of air under pressure, the air displacing or being displaced by water, apparatus for automatically levelling the cradle during the lifting and lowering processes comprising:

means fixed to the lift for listing therewith;

a V-shaped track disposed on said listing means, said track having a starboard arm disposed to rotate below horizontal at a predetermined degree of starboard list of said listing means and a port arm disposed to rotate below horizontal at a predetermined degree of port list of said listing means;

means disposed on said track for moving toward an extremity thereof when one of said arms rotates below horizontal and for moving toward the center thereof when both of said arms are above horizontal; and means responsive to the location of said moving means for blocking the flow of air into those pontoons on the higher side of said lift during the lifting process and for blocking the flow of air out of those pontoons on the lower side of said lift during the lowering process.

2. Apparatus according to claim 1, said responsive means comprising:

at least two intake valves, one in the air inlet path of the starboard pontoons and ,one in the air inlet path of the port pontoons;

at least two exhaust valves, one in the air outlet path of the starboard pontoons and one in the air outlet path of the port pontoons;

at least two starboard lever mechanisms, one linked to said intake valve and the other linked to said exhaust valve of the starboard pontoons; and at least two port lever mechanisms, one linked to said intake valve and the other linked to said exhaust valve of the port pontoons.

3. Apparatus according to claim 2 further comprising a pair of fulcra, one fixed to the underside of each of said arms, whereby, when said moving means nears the extremity of one of said arms, said V-shaped track operates as a lever about the fulcrum of said one of said arms, said starboard lever mechanisms being operable in response to rotation of said track about said starboard fulcrum and said port lever mechanisms being responsive to rotation of said track about said port fulcrum.

4. For use with a boat lift having a cradle lifted or lowered by the respective introduction into or evacuation from lateral pontoons supporting the cradle of air under pressure, the air displacing or being displaced by water, apparatus for automatically leveling the cradle during the lifting process, the lowering process and storage comprising:

means fixed to the lift for listing therewith;

a V-shaped track disposed on said listing means, said track having a starboard arm disposed to rotate below horizontal at a predetermined degree of starboard list of said listing means and a port arm disposed to rotate below horizontal at a predetermined degree of port list of said listing means;

means disposed on said track for moving toward an extremity thereof when one of said arms rotates below horizontal and for moving toward the center thereof when both of said arms are above horizontal; and means responsive to the location of said moving means for blocking the flow of air into those pontoons on the higher side of said lift during the lifting process, for blocking the flow of air out of those pontoons on the lower side of said lift during the lowering process and for bleeding air from those pontoons on the higher side of said lift during storage.

5. Apparatus according to claim 4, said blocking means comprising:

at least two intake valves, one in the air inlet path of the starboard pontoons and one in the air inlet path of the port pontoons;

at least two exhaust valves, one in the air outlet path of the starboard pontoons and one in the air outlet path of the port pontoons;

at least two starboard lever mechanisms, one linked to said intake valve and the other linked to said exhaust valve of the starboard pontoons;

at least two port lever mechanisms, one linked to said intake valve and the other linked to said exhaust valve of the port pontoons; and at least two bleeder lever mechanisms, one linked to each of said exhaust valves.

6. Apparatus according to claim 5 further comprising a pair of fulcra, one fixed to the underside of each of said arms, whereby, when said moving means nears the extremity of one of said arms, said V-shaped track operates as a lever about the fulcrum of said one of said arms, said starboard lever mechanisms and one of said bleeder lever mechanisms being operable in response to rotation of said track about said starboard fulcrum and said port lever mechanisms and the other of said bleeder lever mechanisms being responsive to rotation of said track about said port fulcrum.

7. A boat lift comprising:

a cradle;

at least two pontoons laterally disposed beneath and fixed to said cradle, each of said pontoons having a water vent through its rear lower surface and an air vent through its forward upper surface;

a pair of pneumatic duct systems, one said system connected to said air vents of the starboard side pontoons and the other said system connected to said air vents of the port side pontoons, each said system including an intake path and an exhaust path and a valve in each said path, said intake path being connectable to a source of air under pressure and said exhaust path extending to the atmosphere;

means selectively actuatable for opening said intake path valves or said exhaust path valves;

means fixed to the lift for listing therewith;

a V-shaped track disposed on said listing means, said track having a starboard arm disposed to rotate below horizontal at a predetermined degree of starboard list of said listing means and a port arm disposed to rotate below horizontal at a predetermined degree of port list of said listing means;

means disposed on said track for moving toward an extremity thereof when one of said arms rotates below horizontal and for moving toward the center thereof when both of said arms are above horizontal; and means responsive to the location of said moving means for automatically closing the intake path valve to the pontoon on the higher side of said lift during periods of the lifting process when one of said arms is below horizontal and for automatically closing the exhaust path valve to the pontoon on the lower side of said lift during periods of the lowering process when one of said arms is below horizontal.

8. Apparatus according to claim 7, said responsive means comprising:

a pair of fulcra, one fixed to the underside of each of said arms, whereby, when said moving means nears the extremity of one of said arms, said V-shaped track operates as a lever about said fulcrum of said one of said arms;

at least two starboard lever mechanisms, one linked to said intake valve and the other linked to said exhaust valve of their laterally respective pontoons; and at least two port lever mechanisms, one linked to said intake valve and the other linked to said exhaust valve of their laterally respective pontoons.

9. A boat lift comprising:

a cradle;

at least two pontoons laterally disposed beneath and fixed to said cradle, each of said pontoons having a water vent through its rear lower surface and an air vent through its forward upper surface;

a pair of pneumatic duct systems, one said system connected to said air vents of the starboard side pontoons and the other said system connected to said air vents of the port side pontoons, each said system including an intake path and an exhaust path and a valve in each said path, said intake path being connectable to a source of air under pressure and said exhaust path extending to the atmosphere;

means selectively actuatable for opening said intake path valves or said exhaust path valves;

means fixed to the lift for listing therewith;

a V-shaped track disposed on said listing means, said track having a starboard arm disposed to rotate below horizontal at a predetermined degree of starboard list of said listing means and a port arm disposed to rotate below horizontal at a predetermined degree of port list of said listing means;

means disposed on said track for moving toward an extremity thereof when one of said arms rotates below horizontal and for moving toward the center thereof when both of said arms are above horizontal; and means responsive to the location of said moving means for automatically closing the intake path valve to the pontoon on the higher side of said lift during periods of the lifting process when one of said arms is below horizontal, for automatically closing the exhaust path valve to the pontoon on the lower side of said lift during periods of the lowering process when one of said arms is below horizontal and for bleeding air from those pontoons on the higher side of said lift during storage.

10. Apparatus according to claim 9, said responsive means comprising:

a pair of fulcra, one fixed to the underside of each of said arms, whereby, when said moving means nears the extremity of one of said arms, said V-shaped track operates as a lever about said fulcrum of said one of said arms;

at least two starboard lever mechanisms, one linked to said intake valve and the other linked to said exhaust valve of their laterally respective pontoons;

at least two port lever mechanisms, one linked to said intake valve and the other linked to said exhaust valve of their laterally respective pontoons; and at least two bleeder lever mechanisms, one linked to each of said exhaust valves.

11. A boat lift comprising:

a cradle;

at least two pontoons laterally disposed beneath and fixed to said cradle, each of said pontoons having a water vent through its rear lower surface and an air vent through its forward upper surface;

a pair of pneumatic duct systems, one said system connected to said air vents of the starboard side pontoons and the other said system connected to said air vents of the port side pontoons, each said system including an intake path and an exhaust path and a valve in each said path, said intake path being connectable to a source of air under pressure and said exhaust path extending to the atmosphere;

means selectively actuatable to a first position for opening said intake path valves and for activating said source of air under pressure to raise the lift, to a second position for opening said exhaust path valves to lower the lift and to a third position for closing said intake path and said exhaust path valves to maintain the lift at a storage level;

means fixed to the lift for listing therewith;

a V-shaped track disposed on said listing means, said track having a starboard arm disposed to rotate below horizontal at a predetermined degree of starboard list of said listing means and a port arm disposed to rotate below horizontal at a predetermined degree of port list of said listing means;

means disposed on said track for moving toward an extremity thereof when one of said arms rotates below horizontal and for moving toward the center thereof when both of said arms are above horizontal; and a pair of fulcra, one fixed to the underside of each of said arms, whereby, when said moving means nears the extremity of one of said arms, said V-shaped track operates as a lever about said fulcrum of said one of said arms;

three starboard lever mechanisms operable in response to the rotation of said arms about said fulcra, the first for closing said starboard intake valve when said actuatable means is in its first position and the lift lists to port the second for closing said starboard exhaust valve when said actuatable means is in its second position and the lift lists to starboard and the third for slightly opening said starboard exhaust valve when said actuatable means is in its third position and the lift lists to port; and three port lever mechanisms operable in response to the rotation of said arms about said fulcra, the first for closing said port intake valve when said actuatable means is in its first position and the lift lists to starboard, the second for closing said port exhaust valve when said actuatable means is in its second position and the lift lists to port and the third for slightly opening said port exhaust valve when said actuatable means is in its third position and the lift lists to starboard.

12. Apparatus according to claim 11, said selectively actuatable means comprising:

an A.C. power source;

a selector switch interrupting said power source and having an input terminal, two output terminals and an off terminal;

an intake path solenoid and a motor of said source of air connected in parallel to the first of said output terminals;

an exhaust path solenoid connected to the second of said output terminals;

an intake control rod responsive to said intake path solenoid to open said intake valves; and an exhaust control rod responsive to said exhaust path solenoid to open said exhaust valves.

13. Apparatus according to claim 12, said selector switch being remotely operable.

14. Apparatus according to claim 11, said moving means comprising two balls, one disposed in each arm of said track, said track having three vertical plates, one fixed at its midpoint and one fixed at each end thereof to limit the travel of said balls.

15. Apparatus according to claim 14 further comprising a pair of spaced apart guide rods disposed above and substantially parallel to said track to prevent said balls from leaving said track.

16. Apparatus according to claim 15 wherein the outer extremities of said track are slightly upwardly bent.

17. Apparatus according to claim 11, each of said valves comprising a section of resiliently pinchable tubing.

18. Apparatus according to claim 11 further comprising ballast means fixed on a forward portion of the lift.

* * * * *